US006448700B1

(12) United States Patent
Gupta et al.

(10) Patent No.: US 6,448,700 B1
(45) Date of Patent: Sep. 10, 2002

(54) SOLID DIAMOND FIELD EMITTER

(75) Inventors: Mool Chand Gupta; Ganapati Rao Myneni, both of Yorktown, VA (US)

(73) Assignee: Southeastern Universities Res. Assn., Newport News, VA (US)

( * ) Notice: Subject to any disclaimer, the term of this patent is extended or adjusted under 35 U.S.C. 154(b) by 0 days.

(21) Appl. No.: 09/425,410

(22) Filed: Oct. 25, 1999

(51) Int. Cl.[7] ..... H01J 1/02

(52) U.S. Cl. ..... 313/309; 313/336; 313/351; 313/495

(58) Field of Search ..... 313/309, 336, 313/351, 495

(56) References Cited

U.S. PATENT DOCUMENTS 5,825,122 A * 10/1998 Givargizov et al. ..... 313/336

6,184,611 B1 * 2/2001 Saito et al. ..... 313/310

* cited by examiner

*Primary Examiner*—Vip Patel

(57) ABSTRACT

The present invention provides a "solid" diamond, i.e. greater than 5$\mu$ thick, electron emitter that has been "machined" using non-contact techniques to a point having a radius of less than about 100$\mu$, preferably below about 10$\mu$ and most preferably between about 3 angstroms and about 3$\mu$. The solid diamond electron emitters of the present invention can perform, even at these small radii, as multi-point emitters depending upon the radius and roughness of the pointed tip and can be used in arrays to obtain relatively large area field emitters for applications where such larger field emissions are necessary. Production of the solid diamond emitters of the present invention is preferably accomplished using non-contact electron or ion beam machining techniques. Residual gas analyzers (RGA) and field emitter extractor gauge analyzers (FERGA) that use the solid diamond emitters are also described.

11 Claims, 2 Drawing Sheets

SOLID DIAMOND FIELD EMITTER

FIELD OF THE INVENTION

The present invention relates to field emitter electron sources for use in ultra-high vacuum (UHV) and extremely high vacuum (XHV) instrumentation, and more particularly to diamond based such emitters.

BACKGROUND OF THE INVENTION

Present day Ultra High Vacuum and Extremely High Vacuum instrumentation is based primarily on thermoionic electron sources. These sources operate at very high temperatures and consequently, tend to desorb gases from the walls of the vacuum chamber and instrumentation thereby affecting the pressure one is trying to measure. Additionally, at the normal operating current of about 1 mA, they also affect the pressure measurement due to electron stimulated desorption of gases from the vacuum walls as well as the elements of the instruments.

Several attempts have been made to substitute field emitter array cold electron sources for the thermoionic electron sources. However, these field emitters have relatively large surface areas and create problems due to continuous outgassing.

Cold-cathode electron field emitters using diamonds have been suggested in the prior art because of the negative electron affinity of their surfaces, but these emitters are generally based on thin films of diamonds (less than about 5$\mu$) or alternatively, thin layers of diamond particles embedded in a coating material. While these have often provided improved emitters, the density of their emission fields is often hard to control and not sufficient to provide optimum performance for vacuum instrumentation. Additionally, in the case of bonded diamond particles, the coating is a source of additional measurement interference.

SUMMARY OF THE INVENTION

According to the present invention there is provided a "solid" diamond i.e. greater than 5$\mu$ thick, electron emitter that has been "machined" using non-contact techniques to a point having a radius of less than about 100$\mu$, preferably below about 10$\mu$, and most preferably between about 3 tenths of an angstrom and about 3$\mu$. The solid diamond electron emitters of the present invention can perform, even at these small radii, as multi-point emitters depending upon the radius and roughness of the pointed tip. The emitters of the present invention can be used in arrays of individual emitters to obtain relatively large area emitter fields for applications where such fields are necessary. Production of the solid diamond emitters of the present invention is preferably accomplished using non-contact electron or ion beam or laser machining techniques.

Residual gas analyzers (RGA), field emitter extractor gauge analyzers (FERGA), Faraday cup detectors and other high and ultra high vacuum devices utilizing the solid diamond emitters of the present invention as well as free electron lasers and Linacs that use the technology described herein are also possible.

DETAILED DESCRIPTION

The development of instrumentation useful in extremely high vacuum environments that do not cause measurement disruptive releases of adsorbed gases has been a perplexing problem. Since most such prior art devices rely of thermoionic electron emitters the release of the interfering gases is an inherent property of the emission process. As described above, attempts to solve the problem using cold field emitters have proven largely similarly ineffective due to the relatively large surface areas of such emitters that also desorb gases. The use of thin films of diamonds (<5$\mu$) or diamond chips embedded in a suitable matrix has also proven of limited effectiveness.

It has now been discovered that the use of single or arrays of "solid" diamond emitters obviate the interference/disturbance problems indicated with prior art systems. According to the present invention there is provided a "solid" diamond i.e. greater than 5$\mu$ thick—(T in FIG. 2)—, emitter that has been "machined" using non-contact techniques to a point having a radius of less than about 10$\mu$ and preferably between about 5 and about 10 angstroms.

Figure 1:
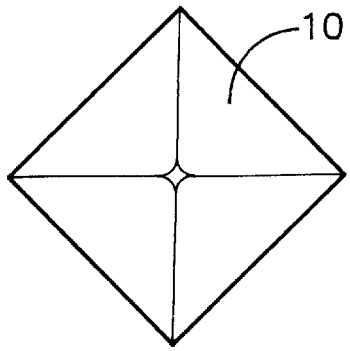
FIGS. 1–3 depict individual steps in the solid diamond fabrication process described herein.
Figure 2:
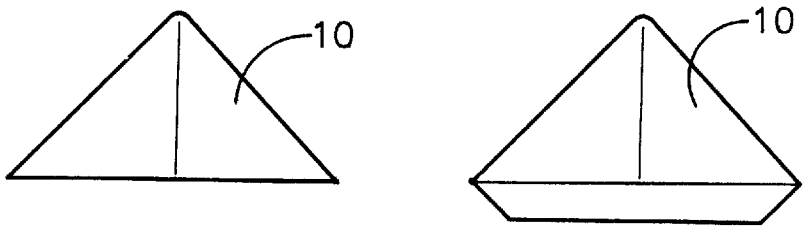
Figure 3:
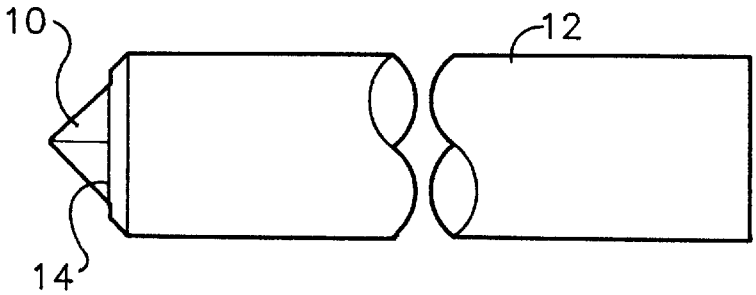

As shown in FIGS. 1–3, preparation of the solid diamond field emitters of the present invention first involves (FIG. 1) selection of a raw diamond 10 having octahedrons at a level of between about 700–900 per carat or between about 0.5 and 0.6 mm in size. The raw diamond should be free of flaws, inclusions, free carbon, and cracks and demonstrate a good octahedral shape.

The raw diamond 10 is then sawed in the (001) or cube plane as shown in FIG. 2.

The sawed diamond 10 is then mounted on a suitable steel shank 12 (FIG. 3) using a titanium-based "adhesive" 14 applied using well known and conventional techniques under high vacuum. A CuAgTi alloy is preferred as the "adhesive" material. Alternatively, electron beam deposited palladium and titanium metals form adherent coatings on diamond surfaces and can be used to adhere diamond 10 to shank 12.

Figure 4:
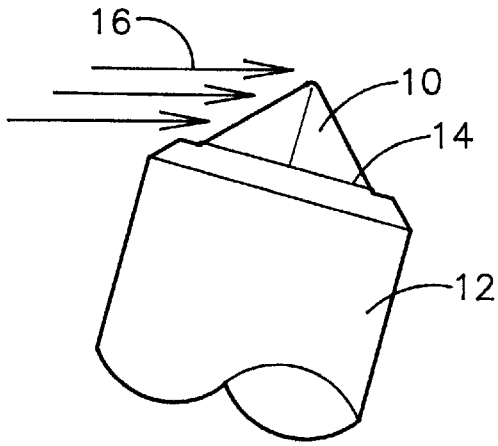
FIG. 4 is a schematic diagram of the final or finishing step of the manufacturing process used to fabricate the solid diamond electron emitters of the present invention.

"Machining" is accomplished as shown in FIG. 4. Sawed diamond 10, mounted on steel shank 12 via "adhesive" layer 14 is angularly rotated, preferably at a 30° angle, as required in ion beam 16 to achieve the desired shape described below. An electron beam that incorporates no ions could also be used to etch diamond 10 in the manner described. Ion beam 16 is similar to that used in transmission electron microscopy for purposes of preparing samples under examination. If an electron beam is used, conventional such beams that are known to etch diamond are satisfactory. An ion gun of the type supplied by Commonwealth Scientific Corporation has been found suitable for this application.

Because of the thickness of the tip of diamond 10 in its final form, described below, mechanical methods cannot be used to achieve the polishing or shaping of diamond 10 since the mechanical pressures applied will result in breakage of diamond 10. Thus, some non-contact "machining" means such as ion or electron beam must be used. The use of lasers as non-contact machining tools is generally impossible in this application due to the thermal shock imparted to diamond 10 in such a laser machining process. Laser machining using femtosecond or picosecond pulses may, however, be possible since at these short pulse widths, heating or thermal shock is not as much of a problem. Chemical etching techniques are of course not useful because of the inertness of diamond.

In the practical instrumentation applications of the solid diamond field emitters of the present invention it is desirable to have large field emission currents on the order of milliamperes and low voltage. To fulfill these requirements, the material tip should be very sharp. In order to obtain such a sharp tip, preferably on the order of from about 3 angstroms up to about 100$\mu$, and preferably from about 5 angstroms up to about 10$\mu$ and most preferably, as in the case of high current instruments operating in the range of 100 volts, from about 3 angstroms up to about 3$\mu$, diamond 10 is manipulated in ion or electron beam 16 using conventional manipulation techniques to achieve the desired tip radius.

Since even with fine radii of the dimensions just described, the surface of diamond 10 after ion or electron beam machining will not be perfectly smooth, a single solid diamond tip of the type described herein may act as an array of tips depending upon the surface roughness of the tip. For the larger radii tips a surface roughness (peak height) of between about 20 angstroms and about 1$\mu$ is preferred. Most preferred, however, is a surface roughness of less than about 10 angstroms for those applications wherein single point electron field emission is desired.

The shape of the solid diamond tip is not particularly critical, i.e. it can be a wide cone, a narrow cone or even an asymmetric shape, so long as some portion of its extreme surface is pointed within the radius parameters just described.

Where a wide field emission is required, a plurality of the solid diamond emitters of the present invention can be arrayed to provide whatever breadth of electron field is desired. Indeed, the appropriate surface roughness, as just described, may provide a sufficient number of diamond points to provide a broader field of electron emission than would be achieved with a "smoother" solid diamond surface. Arrays of the emitters of the present invention that include the pointed solid diamond electron emitter mounted or adhered to an appropriate conductive shank as described above are useful in many types of instrumentation.

Figure 5:
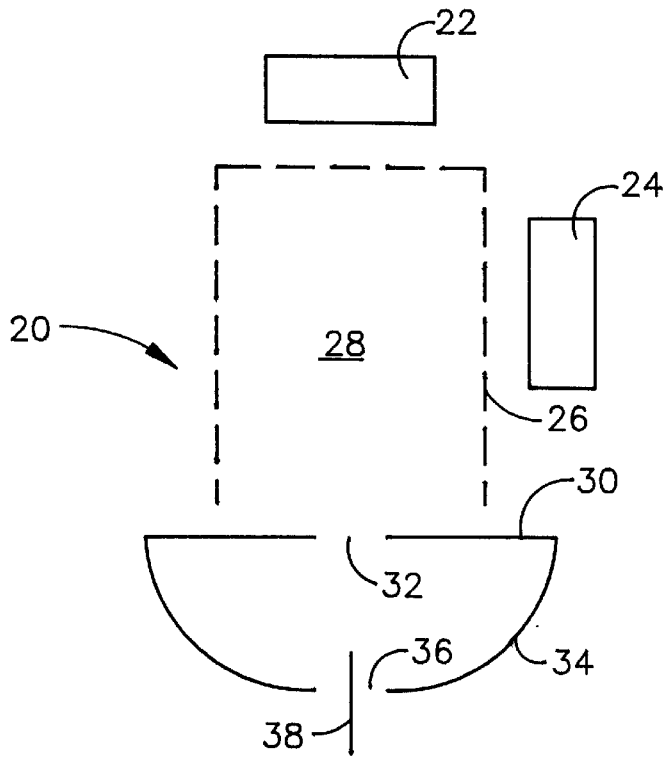
FIG. 5 is a schematic diagram of a field emitter extractor gauge (FEG) capable of utilizing an array of the solid diamond emitters of the present invention.

FIG. 5 schematically depicts a field emitter extractor gauge (FEG) of the type in which the solid diamond emitter of the present is useful. As shown in FIG. 5, FEG 20 comprises field emitter 22 or 24. In the case of field emitter 22, the device is called a Top FEG while in the case where field emitter 24 is present the device is called a Side FEG. Anode grid 26 surrounds the volume 28 and serves to direct the flow of electrons from either field emitter 22 or field emitter 24 toward focus plate 30 having aperture 32 therein. Reflector 34 reflects electrons passing through aperture 32 at an obtuse angle back toward focus plate 30. Aperture 36 in reflector 34 allows passage of a focused electron beam to collector 38. Arrays of the solid diamond emitters of the present invention are useful as either the top or side FEG configurations.

Figure 6:
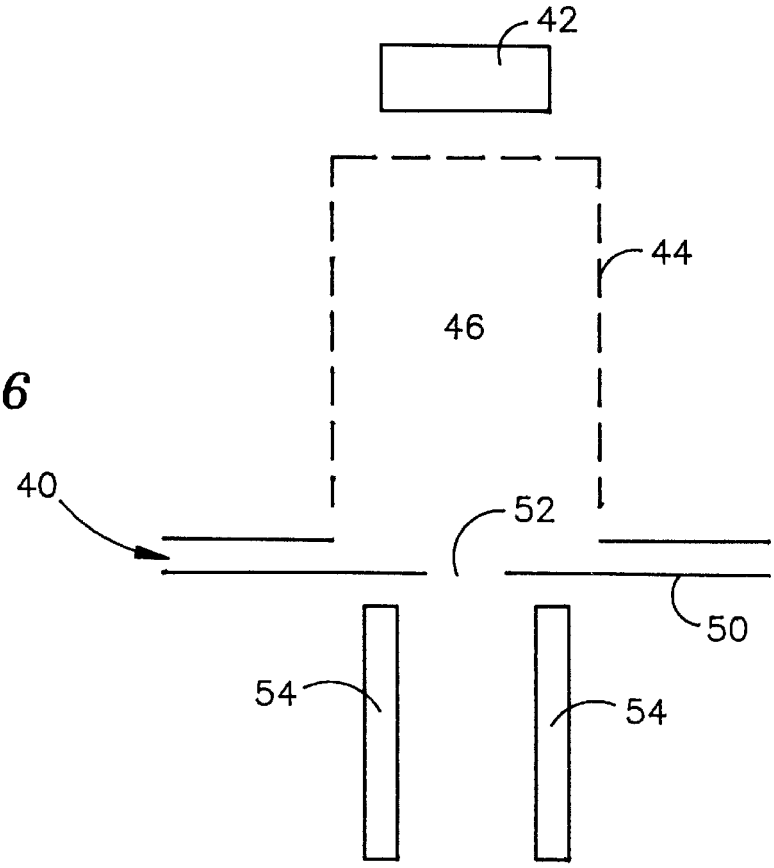
FIG. 6 is a schematic diagram of a field emitter residual gas analyzer (FERGA) capable of utilizing an array of the solid diamond emitters of the present invention.

FIG. 6 depicts schematically a field emitter residual gas analyzer (FERGA) that can utilize the solid diamond field emitters of the present invention. As shown in FIG. 6, the FERGA 40 comprises: 1) a field emitter array 42 that can be a solid diamond field emitter or an array of such emitters of the type described herein; an anode grid 44 enclosing volume 46 to direct electrons from field emitter array 42; focus plate 50 having aperture 52 therein that permits passage of a focused electron beam through focus plate 50, and quadrupole 54.

As the invention has been described, it will be apparent to those skilled in the art that the same may be varied in many ways without departing from the spirit and scope of the invention. Any and all such modifications are intended to be included within the scope of the appended claims.

What is claimed is:

1. A solid diamond electron emitter comprising a diamond greater than 5 $\mu$m in thickness having a pointed surface with a radius of less than about 100 $\mu$m, said pointed surface having a roughness of between about 20 angstroms and about 10 $\mu$m.

2. The solid diamond electron emitter of claim 1 wherein said point has a surface roughness below about 10 angstroms.

3. The solid diamond electron emitter of claim 1 wherein said radius is less than about 10 $\mu$m.

4. The solid diamond electron emitter of claim 1 wherein said radius ranges form about 3 angstroms to about 3 $\mu$m.

5. The solid diamond electron emitter of claim 1 further including a conductive shank to which said diamond is adhered.

6. The solid diamond electron emitter of claim 4 wherein said diamond is adhered to said conductive shank by a vapor deposited layer of palladium or titanium.

7. The solid diamond field emitter of claim 5 wherein said radius is less than about 10 $\mu$m.

8. The solid diamond electron emitter of claim 5 wherein said radius ranges from about 3 angstroms to about 3 $\mu$m.

9. The solid diamond electron field emitter of claim 4 wherein said point is produced using a non-contact machining technique.

10. The solid diamond electron emitter of claim 8 wherein said non-contact machining technique is selected from the group consisting of electron beam, ion beam and laser machining techniques.

11. A field emitter extractor gauge comprising a field emitter array, an anode grid, a focus plate, a reflector and a collector wherein said field emitter array comprises an array of solid diamond electron emitters each comprising a diamond greater than 5 $\mu$m in thickness having a pointed surface with a radius of less than about 100 $\mu$m, said pointed surface having a roughness of between about 20 angstroms and about 10 $\mu$m.

* * * * *